United States Patent [19]

Fischer

[11] 4,409,895

[45] Oct. 18, 1983

[54] EXPANSIBLE ROTARY OFFSET PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 317,420

[22] Filed: Nov. 2, 1981

[30] Foreign Application Priority Data

Dec. 1, 1980 [DE] Fed. Rep. of Germany ..... 3045164

[51] Int. Cl.[3] ..... B41F 13/24

[52] U.S. Cl. ..... 101/248; 101/183; 101/229

[58] Field of Search ..... 101/248, 174, 183, 184, 101/185, 177, 217–218, 246, 229, 231, 137, 142

[56] References Cited

U.S. PATENT DOCUMENTS

| | | | |
|---|---|---|---|
| 1,875,869 | 9/1932 | Hense | 101/142 |
| 2,479,023 | 8/1949 | Peyrebrune et al. | 101/183 |
| 2,593,180 | 4/1952 | Pritchard | 101/142 |
| 3,057,292 | 10/1962 | Larsen | 101/174 |
| 3,570,398 | 3/1971 | Mowry | 101/183 |
| 3,884,146 | 5/1975 | Ruetschle | 101/248 |
| 4,015,522 | 4/1977 | Preuss et al. | 101/183 |
| 4,222,326 | 9/1980 | Mathes et al. | 101/183 |
| 4,343,241 | 8/1982 | Rudolph et al. | 101/231 |

FOREIGN PATENT DOCUMENTS

| | | | |
|---|---|---|---|
| 2139831 | 2/1973 | Fed. Rep. of Germany | 101/183 |
| 2314302 | 9/1974 | Fed. Rep. of Germany | 101/183 |
| 2046173 | 11/1980 | United Kingdom | 101/174 |

*Primary Examiner*—E. H. Eickholt

*Attorney, Agent, or Firm*—Frishauf, Holtz, Goodman & Woodward

[57] ABSTRACT

To permit, selectively, positioning of drums or cylinders in rotary sheet printing machines having, selectively, different functions, a cylinder layout is provided, generally in form of an inverted Y, which permits placing, selectively, blanket cylinders, transfer drums, chain system delivery drums and the like at predetermined locations so that, with six bearing positions (9–14) in a standard side wall (1), different printing modes and arrangements providing for single or multiple prime (P, P') and verso (V) printing can be effected, the printing positions being, for example, formed by bores for bearings of the respective cylinders which, if not used, can be plugged or left as space areas, preferably with marked centers, in the side walls; a standard side wall thus can be provided for multiple types of machines which also permit subsequent expansion of machine printing capability without exchange of side wall support or frame structure. The standardized side walls and layout permits application of single prime printing (P), verso printing (V), prime and verso printing (P, V) or multiple prime printing (P, P') with or without verso (V) printing.

2 Claims, 5 Drawing Figures

EXPANSIBLE ROTARY OFFSET PRINTING MACHINE

Figure 1:
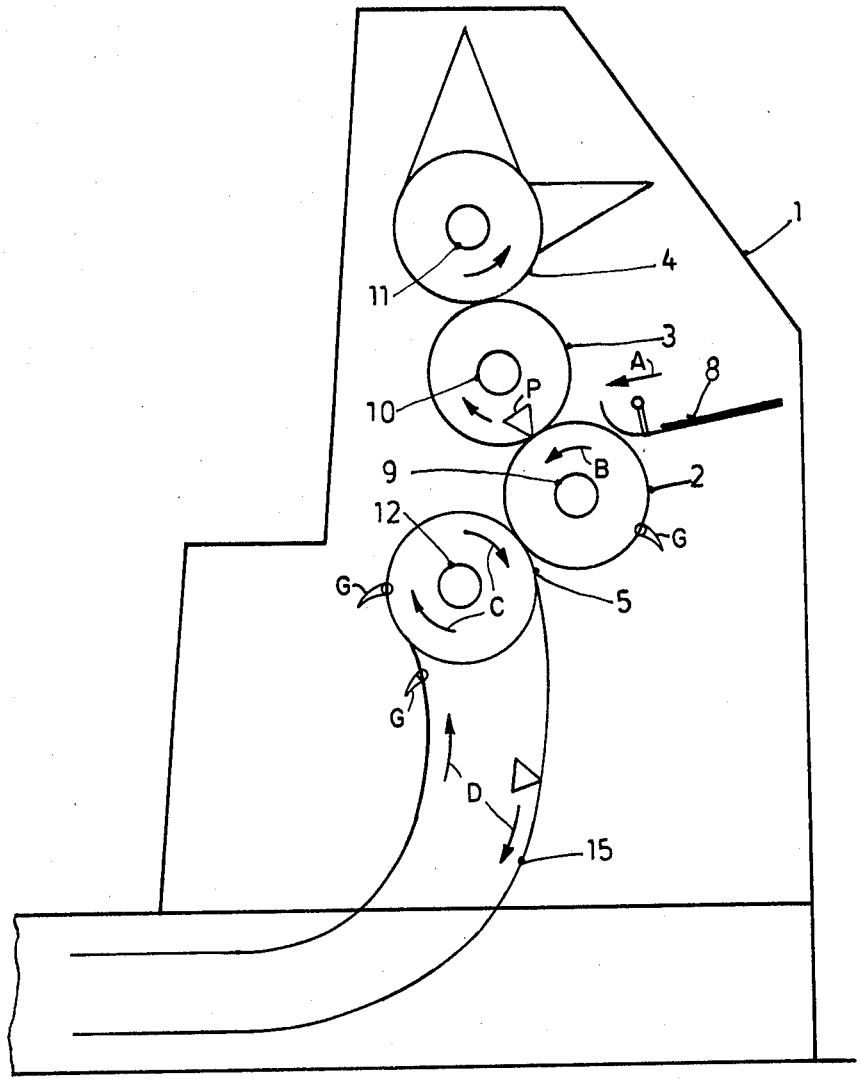

The present invention relates to a rotary offset printing machine, and more particularly to a rotary offset sheet printing machine construction, which is so arranged that the printing systems, or printing to be done, can be selectively changed and rearranged to permit, selectively, single or multiple prime printing or verso printing, without substantial change of the machine itself; and, further, to a printing machine arrangement or layout which permits different cylinder arrangements to be placed therein without entirely changing the cylinder layout of the machine.

BACKGROUND

Various construction arrangements for printing machines are known, and reference is made to the textbook "Einführung in den Offsetdruck" ("Introduction to Offset Printing"), by Wolfgang Walenski, published by Egger-Fachbuchreihe (Technical Book Series). Pages 128, 129 of this book describe a construction layout for single-color sheet offset printing machines and for dual-color sheet offset printing machines, from which it can be seen that similar cylinder walls can be used for different construction layout steps. The arrangement of the cylinders to apply a first prime printing can be retained even if a further printing cylinder is added which permits a second prime printing to be effected.

THE INVENTION

It is an object to provide a printing machine layout and construction arrangement which permits wider standardization of the supporting side walls, while permitting widely different machine layouts and cylinder arrangements, and especially the relationship of printing cylinders and printing drum configurations of the machine itself.

Briefly, the side walls are formed with a maximum of six openings, in each side wall, to receive bearings for cylinders or rollers which are so placed and located with respect to each other that the particular bearings or rollers can be interchanged and that, furthermore, space is available for expansion of the printing system by adding additional bearings or rollers. This space will be used for bearing positions, and holes for the bearings themselves can be preformed within the side walls to be utilized when needed, or plugged when not; or, alternatively, the space for the additional bearing holes can be allowed and, if desired, the centers thereof prespotted so that,, if at a later time it is desired to change the cylinder layout of the machine, the appropriate space and centering positions will be available for cylinders or rollers in the exiting side walls.

In accordance with the invention, the side walls include a positioning layout thereon which has a maximum of six predetermined, fixed bearing positions on each side wall, one of the bearing positions being arranged and located for the bearing of, selectively, an impression cylinder or a rubber blanket cylinder to, respectively, receive a substrate such as a sheet of paper. Another one of the bearing positions is arranged and located for the bearing of a rubber blanket cylinder to cooperate with an impression cylinder, if placed in the first bearing position; a further one of the positions is arranged and located for the bearing position of, selectively, a rubber blanket cylinder or a sheet removal drum or a sheet transport system drum of a chain transport system which, again, respectively cooperates with the impression cylinder or another cylinder of the printing machine; and at least one further position is provided, so arranged and located that the bearing position can receive a further printing cylinder for cooperation with any one of the cylinders or drums above referred to.

In dependence on the type of printing machine, and the type of printing to be effected, predetermined bearing positions therefor are available to receive drums, rollers or cylinders of the printing machine which are not necessary for the minimal prime printing on one side of a sheet so that, as desired and as selectively expanded, the machine can carry out prime and verso printing in various printing layouts.

By use of a predetermined arrangement or layout for the centers of bearings to receive cylinders, that is, by providing a fixed predetermined boring or drilling layout to receive the respective cylinders or drums, various arrangements of cylinders and drums used in the machine then become possible. The side walls, predrilled or pre-spotted, or allowing space for positions of a maximum of six cylinders or drums can be prearranged at the initial manufacture with six bores or openings at fixed predetermined positions, generally placed in inverted Y configuration. In dependence on the particular printing arrangement desired, to effect particular types of printing steps or sequences, printing cylinders or drums can then be inserted in some or all of the pre-drilled bores. If fully and completely utilized, double prime printing and one verso printing is possible by placing cylinders or rollers in all the six holes. Any bores which are not needed, for example upon requirements for printing which do not go to the fullest capability of the layout, can be covered or plugged. Of course, it is equally possible upon manufacture to predrill only those holes which are needed for the cylinders or drums of a printing system which is then ordered—the positions for subsequent cylinders, drums or rollers being available, however, to permit future expansion. Thus, subsequent expansion of the printing system by adding further cylinders, drums or rollers, can be readily effected by then utilizing the reserved bearing positions. A rubber blanket cylinder may be used, simultaneously, as an output supply or transfer cylinder, and thus the use of a compressed air-operated delivery drum can be eliminated.

DRAWINGS

FIG. 1 is a schematic side view of the basic printing machine utilizing four bearing positions; and FIGS. 2–5 are schematic side views, similar to FIG. 1, in which the basic system of FIG. 1 is expanded by use of additional drums or cylinders, and illustrating various possibilities of printing system layouts.

Only one of the side walls is seen in the figures; a second side wall, similar to wall 1 shown, is axially behind the illustration of the figures. FIG. 1 illustrates drums 2–5 which can print on a sheet 8 supplied thereto. In dependence on the printing desired, additional printing cylinders 6, 7 (see FIGS. 2, 3) can be used, and the layout can be varied—compare FIGS. 4 and 5. In dependence on the number of cylinders and the specific layout, printing can be done with a single prime printing, two prime printings, one verso print, one prime print and one verso print, or two prime prints and one verso print; the cylinder arrangement and layout, at least in part, required for a particular printing mode, may be varied, as will appear in detail below.

Figure 2:
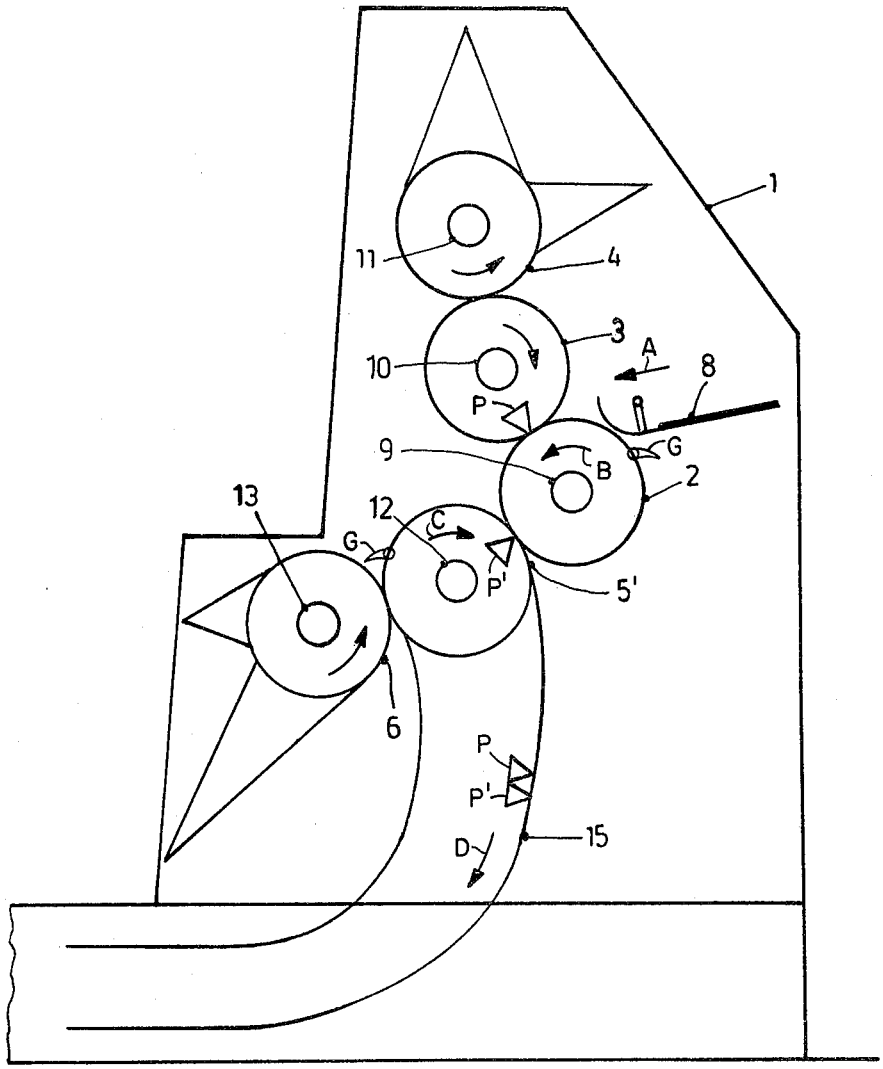
Figure 3:
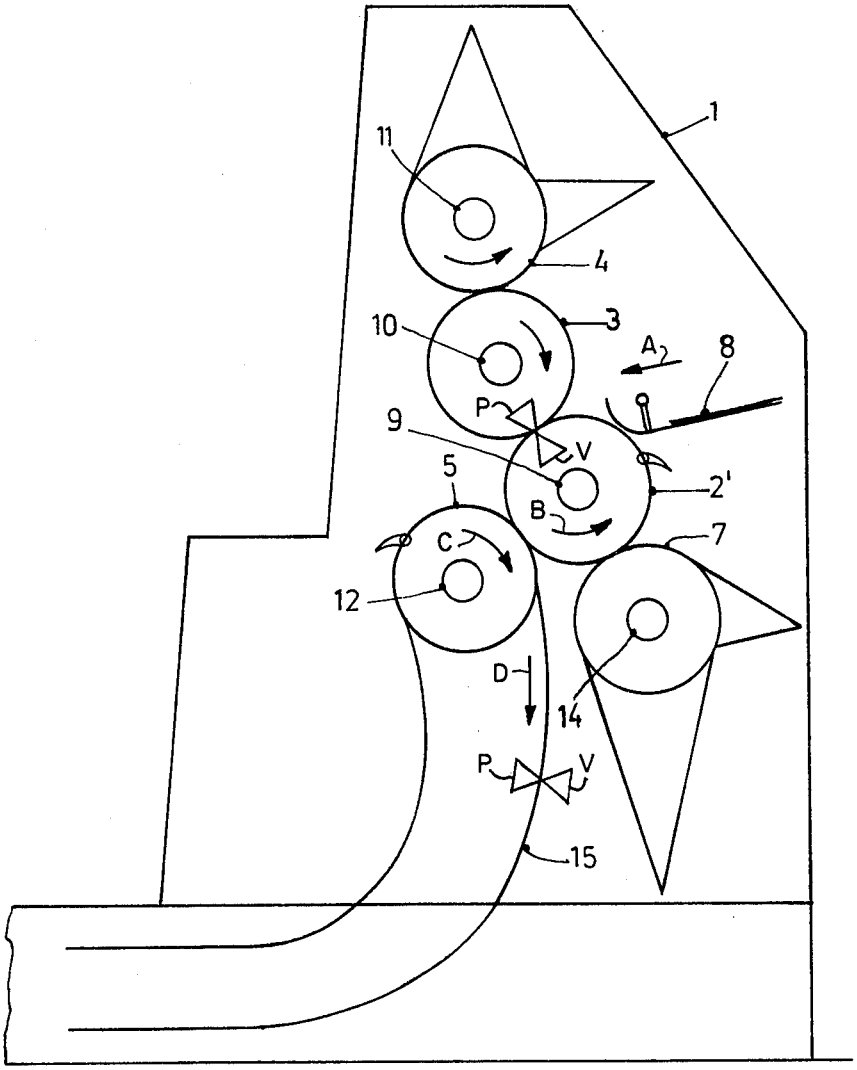
Figure 4:
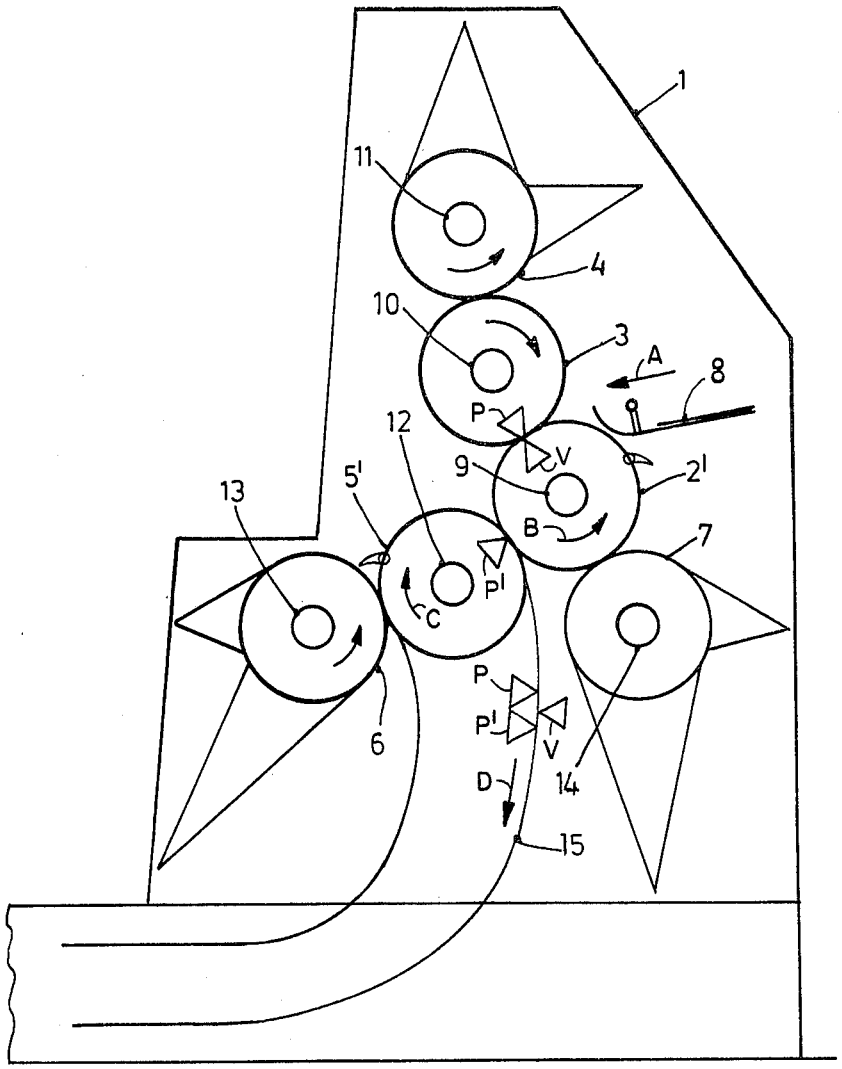
Figure 5:
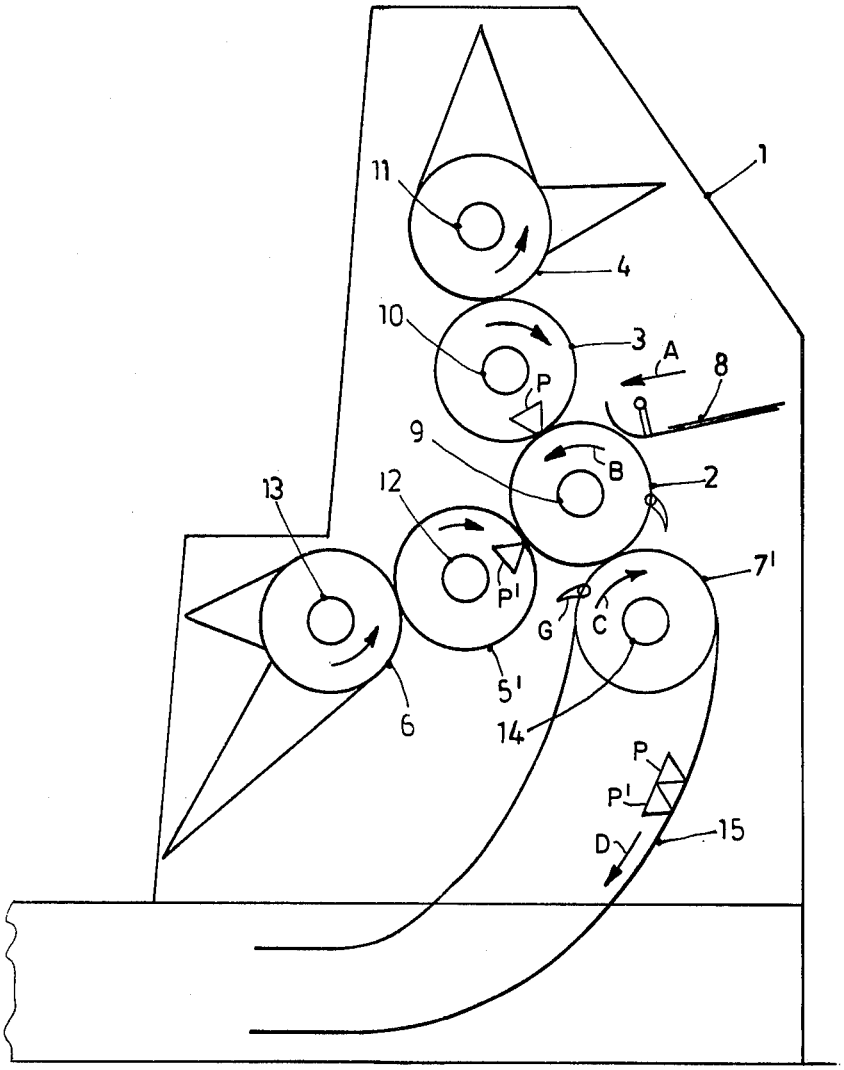

In accordance with a feature of the invention, predetermined bearing positions at predetrmined locations are provided; a maximum of six bearing positions 9 to 14 are provided for, of which positions 9, 10, 11 and 12 are seen in FIG. 1, and 13 and 14, respectively, in FIGS. 2 and 3, and in FIGS. 4 and 5. These positions provide for fixed locations in the side wall. As shown in FIG. 1, the positions are illustrated as bores or bearing holes or bearing reception areas but, of course, they may also be merely reserved spaces for the respective cylinders, preferably, in any event, at least having their centers marked.

FIG. 1 illustrates a simple system with three printing cylinders 2, 3, 4, and a drum transfer cylinder or 5, with which a single prime printing can be applied to a sheet 8. Cylinder 3 is the rubber blanket cylinder, cylinder 4 a plate cylinder, respectively placed in positions or bearing openings 10, 11. The plate cylinder has connected thereto a damping fountain system, only schematically illustrated in the figure. An impression cylinder 2, secured in bearing openings 9, receives the sheet 8 from a supply system, not further shown, for example from a supply table with vacuum cup transfer or other supply system in accordance with any suitable arrangement feeding the sheet in the direction of arrow A. After application of a single prime printing P between blanket cylinder 3 and impression cylinder 2, the sheet is passed to a delivery drum or transfer cylinder 5, journaled in bearing openings 12, which further transports the sheet to a chain transport system schematically shown at 15. Arrows B, C and D show the movement of the cylinders and the chain 15.

FIG. 2 illustrates the same printing arrangement as in FIG. 1 with the addition, however, that a blanket cylinder 5' is used, rather than a transfer drum 5, positioned in the same bearing location or opening 12 as the transfer drum 5 and that a further plate cylinder 13, with its dampening system and inking system, is in printing engagement with the rubber blanket cylinder 5'. Preferably, the rubber blanket system 5' additionally guides the chain transport system 15 and provides a looping portion therefor. The cylinder arrangement thus has four cylinders which permit printing the sheet 8 with double prime printing.

The arrangement of FIG. 2 can readily be varied. For example, the blanket cylinder 3 and the plate cylinder 4 can be omitted and, still, the remaining three cylinders can be used to provide single prime printing, the impression cylinder 2 accepting the sheet from the supply layout and transferring it to the blanket cylinder 5' which receives printing information from the plate cylinder 6 and, after printing, transfers the sheet to the chain transport system 15.

FIG. 3 illustrates another expansion possibility; the bearing opening 12 again supports a delivery drum 5, as in FIG. 1. The cylinder located in bearing position 9, however, is not merely a printing or impression cylinder but, rather, a blanket cylinder which receives printing information from a plate cylinder 7 journaled at bearing position 14, and having its own dampening and inking systems, as schematically shown in FIG. 3. Cylinders 3, 4 again are rubber blanket and plate cylinders, respectively, but are not necessarily needed. As shown in the arrangement of FIG. 3, including the cylinders 3, 4, one prime printing and one verso printing can be carried out, the sheets being received by the cylinder 2, formed as a blanket cylinder, and being taken out of the printing machine from the chain transport system 15 after being received from the delivery drum 5.

Complete expansion of the machine is shown in FIG. 4, in which all six bearing positions 9 to 14 are utilized, arranged, roughly, in form of an inverted Y. This arrangement of printing cylinders differs from that of FIG. 2 by the addition of the plate cylinder 7 and its dampening and inking fountain system at the bearing or cylinder position 14, the placement of a blanket cylinder 2' at the cylinder position 9, and cooperating with the plate cylinder 7, as shown in detail in FIG. 3. Thus, FIG. 4, essentially, is a combination of the features of FIGS. 2 and 3, in which the sheet 8 can be printed with double prime printing applied by the rubber blanket cylinders 3 and 5', with printing information from plate cylinders 4 and 6, and one verso printing applied by blanket cylinder 2' with printing information from plate cylinder 7. The respective applications of prime and verso printing are shown by the triangles P, P' and V in the figures.

FIG. 5 illustrates yet anothr arrangement, in which the cylinder 2 is formed as an impression cylinder, and the cylinder 7' is a delivery drum or transfer cylinder about which, also, the chain transport system 15 is guided. Drum 7' is located at bearing position 14. The blanket cylinders 3 and 5', each having a plate cylinder 4, 6, respectively, associated therewith, apply two prime printing areas on the sheet 8 which is received by the impression cylinder 2 and, after printing, transferred to the delivery drum 7', and hence for delivery by the chain transport system 15, for example to a delivery stack or delivery table, not shown.

Using only the small number of six cylinder or roller, or drum positions, and suitably locating them on the side wall 1, permits wide versatility and variety in actual construction of the printing machine and the cylinder or roller or drum arrangements thereto. It is thus possible to provide six or seven different printing arrangements, considering also the variations with respect to FIGS. 2 and 3, with one standard side wall. Since the side wall structures are heavy steel plates which cannot readily be replaced in printing machinery, substantial manufacturing advantages accrue in standardizing the printing cylinder or drum or roller layout to be placed thereon, while permitting wide variety in machines which can be supplied therewith, or which can later be retrofitted or expanded, as requirements and use change. An optimum use of available space for cylinders and drums is provided.

At least some of the drums or cylinders, for example the impression cylinder 2, the delivery drum or transport cylinder 5 (FIG. 1) or the rubber blanket cylinder 5' of FIG. 2 have gripper systems G thereon to grip the sheets being transferred thereabout. Similar gripper systems are shown, schematically only, on the other figures, and not further identified for clarity of representation.

I claim:

1. Expansible rotary offset printing machine, permitting, selectively, various arrangements of operating cylinders or rollers, in which said operating cylinders or rollers include at least two of:

a rubber blanket cylinder; an impression cylinder; a plate cylinder; a transfer cylinder; a sheet removal cylinder of a chain transport system, said machine having:

side walls (1);

a plurality of operating cylinders or rollers (2–7);

and bearing positions (9–14) for said cylinders or rollers at predetermined positions in said side walls, the side walls supporting said cylinders or rollers at the predetermined positions, wherein, in accordance with the invention, the side walls include a positioning layout thereon having a maximum of six predetermined, fixed bearing positions (9–14) for each side wall, one (9) of the positions being arranged and located for the bearing position of, selectively, an impression cylinder (2) or a first rubber blanket cylinder (2'), respectively receiving a substrate (8) which is to be printed;

another one (10) of the bearing positions being arranged and located for the bearing of a rubber blanket cylinder (3) for cooperation with the impression cylinder (2) or the first rubber blanket cylinder (2');

a further one (12) of the positions being arranged and located for the bearing of, selectively, a rubber blanket cylinder (5'), or a sheet removal cylinder (5), or a sheet transport drum (5) of a chain transport system (15), any one of said cylinders of the further one (12) of the bearing positions cooperating with, respectively, the impression cylinder (2) or the first rubber blanket cylinder (2') to receive a sheet therefrom;

and wherein at least one additional bearing position (FIG. 2: 13; FIG. 3: 14) is provided, arranged and located for the bearing position of, selectively, at least one additional printing cylinder (6, 7) or a sheet transport cylinder (7') of the chain transport system (15);

wherein the bearing positions(9–14) accept, selectively, (a) a first printing cylinder configuration of:

an impression cylinder (2) located at the first one (9) of the bearing positions, and receiving a substrate sheet (8) on which printing is to be effected;

a plate cylinder—rubber cylinder pair (4, 3) and respective bearing positions (11, 10) therefor, for prime printing by cooperation with the impression cylinder, and a sheet removal cylinder (5) located at said further one (12) of the positions (FIG. 1); or (b) a second cylinder configuration of:

an impression cylinder (2) located at said one position (9) and two plate cylinder—rubber blanket cylinder pairs (4, 3; 6, 5') located at respective bearing positions and at said further one (12) and additional (13) positions, respectively, the second blanket cylinder (5) also forming a sheet removal cylinder for the chain transport system (15) (FIG. 2); or (c) a third cylinder configuration of:

a rubber blanket cylinder (2') receiving the substrate sheet (8) located at said one position (9), a plate cylinder—blanket cylinder pair (4, 3), and a plate cylinder (7) being located at said at least one additional position (14) and cooperating with the blanket cylinder (2') at said one position (9), the further one (12) of the positions having a delivery drum (5) located thereon and forming a looping drum for the chain transport system (15) (FIG. 3); or a fourth cylinder configuration wherein said at least one additional position comprises two positions (13, 14), said one position (9) having a blanket cylinder (2') located thereon, a plate cylinder—rubber blanket cylinder pair (4, 3) located on the side walls; and plate cylinders (6, 7) located at each of said two additional positions (13, 14) and cooperating, respectively, with a rubber blanket cylinder (5') located at said further one position (12) and the rubber blanket cylinder (2') located at said first position, said rubber blanket cylinder (5') at said further one (12) position forming a looping cylinder for the chain transport system (FIG. 4); or (e) a fifth cylinder configuration wherein said at least one additional position comprises two additional positions (13, 14), said at least one position (9) having an impression cylinder located thereon, a plate cylinder—blanket cylinder pair (3, 4) cooperating with said impression cylinder (2), a further plate cylinder (6) being located at one of said additional positions (13), a rubber blanket cylinder (5') being located at said further one position (12) and a transfer drum (7') being located at the second additional position (14) and forming a looping drum for the chain transport system (15) (FIG. 5).

2. Printing machine according to claim 1, wherein at least some of the respective cylinders are formed with sheet gripper systems (G).

* * * * *